US006159306A

United States Patent [19]

Barbour

[11] Patent Number: 6,159,306

[45] Date of Patent: Dec. 12, 2000

[54] CARBURIZING DEVICE AND METHOD OF USING THE SAME

[76] Inventor: George E. Barbour, 3200 S. Jerome Rd., Pittsford, Mich. 49271

[21] Appl. No.: 09/178,642

[22] Filed: Oct. 26, 1998

[51] Int. Cl.[7] ..... C23C 8/22

[52] U.S. Cl. ..... 148/235; 148/225; 266/252; 266/254; 266/257

[58] Field of Search ..... 148/225, 235; 266/257, 251, 252, 254, 140

[56] References Cited

U.S. PATENT DOCUMENTS 4,386,972 6/1983 Knight .

FOREIGN PATENT DOCUMENTS 0840193 6/1981 U.S.S.R. ..... 266/257

*Primary Examiner*—Deborah Yee

*Attorney, Agent, or Firm*—Rankin, Hill, Porter & Clark LLP

[57] ABSTRACT

The present invention provides a new and improved apparatus and method of carburizing ferrous metal parts. In one embodiment of the invention the apparatus comprises a radiant heater tube within which a source of hydrocarbon fuel is fully combusted, and a generator tube surrounding and forming a cavity around at least a portion of the radiant heater tube. The generator tube includes an input for air and enriching gas and an output to the process chamber of the furnace. The enriching gas is partially combusted or decomposed in the generator tube. This partially combusted gas is utilized to produce a carburizing gas for use in the process chamber of the furnace.

15 Claims, 3 Drawing Sheets

CARBURIZING DEVICE AND METHOD OF USING THE SAME

TECHNICAL FIELD

The invention concerns the field of metallurgical heat treating. More particularly, the invention concerns processes for carburizing ferrous metal parts under a controlled atmosphere at elevated temperatures using a novel carburizing device or assembly. These processes are commonly referred to as gas carburizing.

BACKGROUND

Carburization is the conventional process for the case hardening of steel. In gas carburizing the steel is exposed to an atmosphere which contains components capable of transferring carbon to the surface of the metal from which it diffuses into the body of the part. In many carburizing processes, an important constituent of the furnace atmosphere used to carburize metal parts is the carrier gas. A carrier gas serves to provide a furnace atmosphere with a positive carbon potential.

A variety of carrier gases have been employed in carburizing as discussed in U.S. Pat. No. 4,049,472, but the most common carrier gas is the endothermic (endo) gas derived by partial combustion of natural gas in air. When using endothermic gas, it is usually necessary to add a relatively small quantity of another constituent (i.e., enriching gas), usually natural gas, to the atmosphere to raise the carbon potential of the furnace atmosphere.

A thorough discussion of carburizing can be found in the section entitled "Furnace Atmospheres and Carbon Control" found at pages 67 through 92, and that portion of the section entitled "Case Hardening of Steel" appearing at pages 93 through 128 of Volume 2 of the Metals Handbook published in 1964 by the American Society of Metals, Metals Park, Ohio. This particular volume of the Metals Handbook is entitled "Heat Treating, Cleaning and Finishing."

During gas carburization, the steel objects to be carburized are exposed at an elevated temperature, usually in the range of about 1400–1700° F., until carbon penetration to a desired depth has been achieved. The steel objects can then be cooled to room temperature by various known methods such as a furnace, air or media quench to develop the desired physical properties and case hardness in the finished article.

The basic endothermic atmosphere produced by the incomplete combustion of natural gas in air consists of approximately 40% $N_2$, 40% $H_2$ and 20% CO. The reaction by which carbon is generally believed to be deposited on the surface of the steel is represented by the following equation (1):

$$H_2+CO=C+H_2O \quad (1)$$

The water produced in equation (1) immediately reacts partially with more CO according to the well-known water gas shift reaction (2):

$$H_2O+CO=CO_2+H_2 \quad (2)$$

Equations (1) and (2) may be added together to yield reaction (3):

$$2CO=C+CO_2 \quad (3)$$

The net results of carburization by the endothermic atmosphere is the decomposition of carbon on the surface of the metal and concurrent formation of an equivalent amount of $CO_2$ or $H_2O$. These two substances, $CO_2$ and $H_2O$, cause the reversal of reactions (1) and (3) and if allowed to accumulate, would quickly bring the carburization process to a halt. The purpose of adding enriching gas as mentioned above is to remove the $H_2O$ and $CO_2$ and regenerate more active reactive gases according to reactions (4) and (5):

$$CO_2+CH_4=2CO+2H_2 \quad (4)$$

$$H_2O+CH_4=3H_2+CO \quad (5)$$

Another method of generating a carburizing atmosphere which is discussed in U.S. Pat. No. 4,306,918 involves decomposition of methanol, either alone or in combination with nitrogen, according to equation (6):

$$CH_3OH=2H_2+CO \quad (6)$$

It will be noted that the above reaction (6) results in the production of CO the same as is produced by the use of endothermic atmosphere by partial combustion of natural gas. By use of the appropriate quantities of nitrogen and methanol it is possible to generate a synthetic atmosphere which is essentially identical in composition to that produced by the partial combustion of natural gas.

During operation of a furnace, the carbon potential of the furnace atmosphere can become too high. When the carbon potential becomes too high it can lead to the excessive formation of carbon on the metal parts being carburized and the formation of excess carbon in the interior of the furnace. In order to lower the carbon potential of a furnace atmosphere, it is a common practice to acid air to the process chamber of the furnace. Air has also been employed in the prior art in situations where a carrier gas is not generated outside the process chamber. Specifically, air has been used in situations where a combustible gas (e.g., natural gas) is fed into a generator located within the process chamber of the furnace. In such situations, the air serves to decompose the combustible gas in situ in the process chamber of the furnace. U.S. Pat. No. 3,290,030 discloses an apparatus for the generation of furnace atmosphere wherein air and gaseous hydrocarbons are fed into an apparatus which is either located in or beneath the process chamber of the furnace. The air and gaseous hydrocarbons combust in the apparatus to form the furnace atmosphere.

The present invention provides a new and improved apparatus for generating furnace atmosphere in-situ in the process chamber of the furnace using air and an enriching gas. Applicant's apparatus obviates the need for a separately generated carrier gas.

SUMMARY

The present invention provides a new and improved apparatus or device, and method of carburizing ferrous metal parts which affords many distinct advantages over prior art methods and devices. Specifically, the method of the present invention provides shorter carburizing cycles, improved control of carbon potential and avoids carbon clogging of furnace interiors and the clogging and cementing together of the parts that are being carburized. Additionally, the apparatus of the present invention allows one to carburize ferrous metal parts without having to generate or provide a source of carrier gas.

In one preferred embodiment the carburizing device comprises a radiant heater tube wherein a source of hydrocarbon fuel is fully combusted to generate heat for at least partially heating the furnace, and a generator tube surrounding and contiguous with at least a portion of the radiant heater tube.

The generator tube includes an input for a mixture of air and enriching gas, and an output to the process chamber of the furnace. Preferably, the generator tube is filled at least in part with a catalyst to facilitate the partial combustion or decomposition of the enriching gas. Having the generator tube in the immediate proximity of the radiant heater tube ensures a great deal of control over the partial combustion of the enriching gas in the generator tube.

In another embodiment the invention comprises the steps of providing a furnace with a carburizing device as described above, charging such parts to be carburized into the process chamber of the furnace, providing a source of air and hydrocarbon fuel to said radiant heater tube and combusting said fuel in said radiant heater tube, heating the process chamber of the furnace to a temperature in excess of about 1100° F., providing a source of air and enriching gas and feeding such air and enriching gas to the generator tube so as to partially combust such enriching gas and raise the carbon potential of the furnace atmosphere by at least 0.1%, and discharging the parts from the furnace.

The enriching gas may comprise any carbon (C) containing gas or liquid that may be decomposed to provide a source of free carbon (C). The enriching gas may comprise a gas selected from the group consisting of $CH_4$, CO, $C_2H_6$, $C_2H_4$, $C_6H_6$, $C_4H_{10}$, $C_3H_8$ and mixtures of such gases. At least about 0.05 cubic feet of the air is fed into the generator tube for about every one cubic foot of the enriching gas that is fed into the generator tube. Preferably, from about 0.20 cubic feet to about 8 cubic feet of the air is fed into the generator tube for about every cubic foot of enriching gas that is fed into the generator tube.

The foregoing and other features of the invention are hereinafter more fully described and particularly pointed out in the claims below. The following description sets forth in detail certain illustrative embodiments of the invention, these being indicative, however, of but a few of the various ways in which the principles of the invention may be employed.

DETAILED DESCRIPTION

Figure 1:
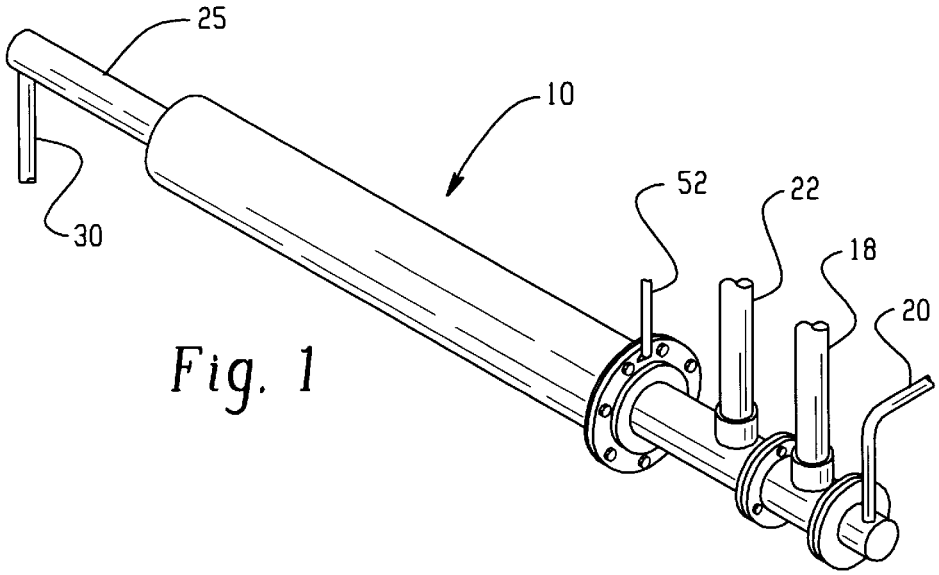
FIG. 1 is a perspective view of the carburizing device of the present invention.

The principles of the present invention may be practiced in conjunction with various furnaces and with various types of enriching gases.

The furnaces with which the present invention may be employed include batch-type furnaces (box furnaces), rotary furnaces, rotary retort furnaces, continuous furnaces (pusher-type) and pit furnaces. These furnaces generally have heating and cooling means, one or more process chambers in which the workpieces are placed on a hearth or platform, or suspended, and exposed to heat and carburizing atmosphere, and one or more doors or accesses through which the steel parts pass into or out of the chamber. In addition to the foregoing, there are usually vents to avoid pressure build-up, vestibules between the doors to the chamber and the outer doors to the furnace, and circulating fans to expedite gas phase mass transfer and heat transfer.

The pusher-type (continuous) furnace differs from the other furnaces only in that it has a series of chambers and doors through which the steel parts are pushed from one end of the furnace to the other. Another important difference between batch furnaces and continuous furnaces is that in batch furnaces carburizing does not begin until the furnace reaches the carburizing temperature, which is typically about 30 minutes after the doors are closed, and there is no door opening until the end of the carburization cycle. On the other hand, in the continuous furnaces, doors are opened and closed frequently, typically about every hour.

The carburizing chambers or process chambers of the furnaces are "closed," which means that vents or any other openings through which gases can pass into or out of the chamber are generally closed throughout the process except, of course, for the passages, door or other openings, through which the steel parts pass into or out of the chamber; gas inlet ports necessary to provide the carburizing atmosphere, venting for purposes of controlling furnace pressure and gas flow and sample ports commonly used for testing purposes. The objective of the "closed" chamber is to keep the influx of oxidizing gases to a minimum and limit losses of carburizing atmosphere. When practicing the present invention, preferably, the process chamber is kept "closed" as much as possible to prevent the uncontrolled outflow of furnace atmosphere and the uncontrolled influx of air.

Door opening and closing and the introduction of the steel workpieces or load may be accomplished manually or automatically, but is, again, conventional as is the internal temperature of the process chamber where the carburizing takes place. This temperature lies within a range of about 1100° F. to about 2200° F. and is generally about 1500° F. to about 1850° F.

Carburizing time is about 0.5 to about 50 hours and is typically about 3 to about 9 hours. Particular times, however, are selected according to the desired effective case depth, the composition of the parts being carburized, the desired carbon content and the carrier (if any) and enriching gases being utilized.

The gases that can be used in connection with the present invention include the gases discussed in U.S. Pat. Nos. 4,049,472 and 4,306,918, the disclosures of which are incorporated herein by reference.

Although not at all required, the carburizing apparatus of the present invention may be used along with a carrier gas. An example of such a carrier gas is an exothermic base gas which is formed by partial or complete combustion of a fuel gas/air mixture. These mixtures may have the water vapor removed to produce a desired dew point in the atmosphere. Another potential carrier gas is a prepared nitrogen base atmosphere which is an exothermic base with carbon dioxide and water vapor removed. Another potential carrier gas is an endothermic carrier gas which is formed by partial reaction of a mixture of fuel gas and air in an externally heated catalyst filled chamber. Another potential carrier gas is a charcoal based atmosphere which is formed by passing air through a bed of incandescent charcoal. Another potential carrier gas is an exothermic-endothermic base atmosphere formed by complete combustion of a mixture of fuel gas and air, removing the water vapor, and reforming the carbon dioxide to carbon monoxide by means of a reaction with fuel gas in an externally heated catalyst filled chamber. Another potential carrier gas is an ammonia base atmosphere which can be formed by raw ammonia, dissociated ammonia, a partially or completely combusted dissociated ammonia with a regulated dew point. The carrier gas may also be of a type which is formed in situ by the decomposition of a hydrocarbon liquid at elevated temperatures. These above gases and others which provide a carburizing atmosphere in a furnace are generically referred to in this specification and the claims below as a "carrier gas." As used in this specification and the claims below the term "carrier gas" means a gas media which in and of itself is capable of providing a neutral or positive carbon potential within the process chamber of a furnace.

In order to impart carbon into the ferrous metal parts which are to be carburized, the furnace atmosphere contained within the process chamber must have a carbon potential. Carbon potential is a measure of the ability of a carburizing gas to increase the carbon level of the ferrous metal parts. The carbon potential will depend on such factors as the temperature of the furnace atmosphere, the dew point of the furnace atmosphere, and the amount of carbon (C) contained in the furnace atmosphere. As the dew point goes down, the carbon potential increases. For purposes of this specification and the claims below "carbon potential" is defined as the weight percent carbon dissolved on a steel surface which is in equilibrium with the furnace atmosphere. The actual carbon potential of a furnace may be measured using various conventional means such as, for example, infrared analyzers and dew point analysis using various conventional means such as a dew cup instrument, a fog chamber, a chilled-mirror apparatus or a chilled-metal apparatus.

The carbon potential of the furnace atmosphere in the process chamber of a furnace is attained and maintained by using an enriching gas/air mixture along with applicant's carburizing device. The enriching gas is generally a gas selected from the group consisting of $CH_4$, CO, $C_2H_6$, $C_2H_4$, $C_6H_6$, $C_4H_4$, $C_3H_8$ and mixtures of such gases. A preferred enriching gas is methane ($CH_4$) because of its cost and availability.

Figure 2:
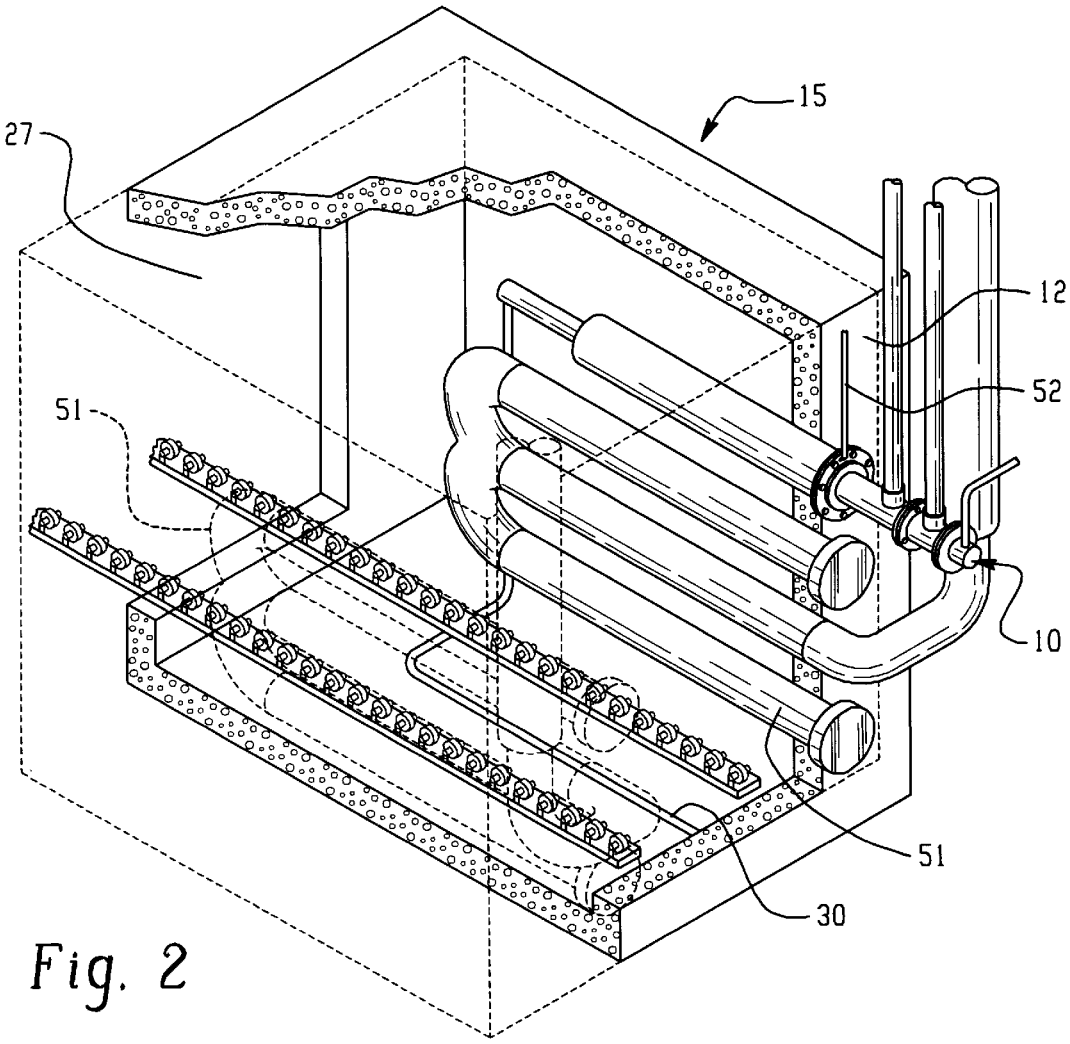
FIG. 2 is a partially broken-away view of a furnace having located therein the carburizing device of FIG. 1.

Referring now to the drawings, and initially to FIGS. 1 and 2 there is illustrated a carburizing device 10 made in accordance with the present invention. Device 10 facilitates the production of a carburizing furnace atmosphere by merely using a source of air and enriching gas. Device 10 is mounted in the sidewall 12 of a furnace 15 as partially illustrated in FIG. 2. Device 10 includes an inlet 18 for air and an inlet 20 for hydrocarbon fuel at its fore-end, and an exhaust outlet 22 for exhausting the combusted air and fuel. Also provided near the fore-end of the device 10 is an inlet for the air and enriching gas that is to be partially combusted by the device 10 to produce a carburizing atmosphere in the furnace 15. Located at the distal end of the device 10 is an outlet tube 25 for the partially combusted enriching gas which is fed into the process chamber 27 of the furnace 15. Attached to the end of the outlet 25 is a diffuser tube 30 which includes numerous apertures or openings and facilitates the distribution of the partially combusted enriching gas within the process chamber 27. It will be appreciated that the configuration of tube 30 may be modified to meet the needs of the particular furnace in which it is installed. In some furnaces, a diffuser tube 30 may not even be required.

Figure 3:
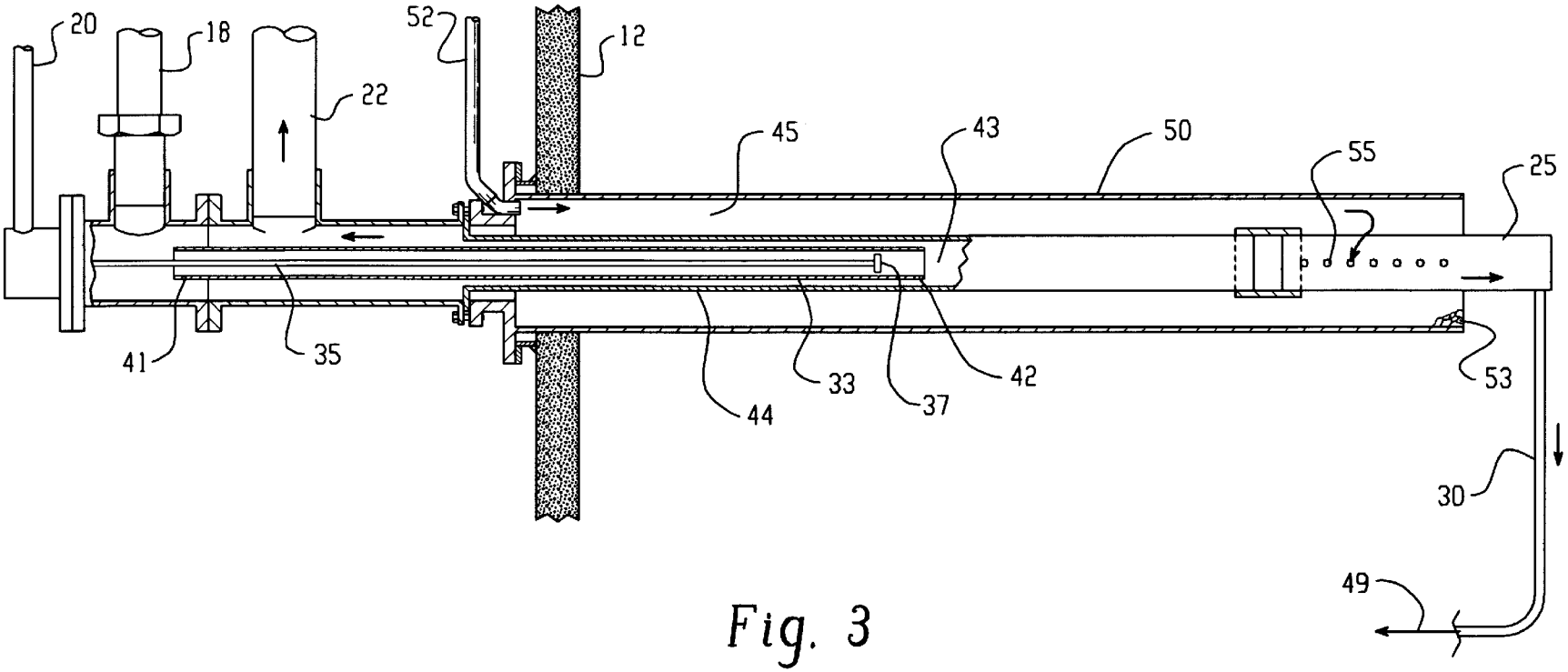
FIG. 3 is a partially cross-sectioned and broken away schematic view of the furnace and carburizing device of FIGS. 1 and 2.
Figure 4:
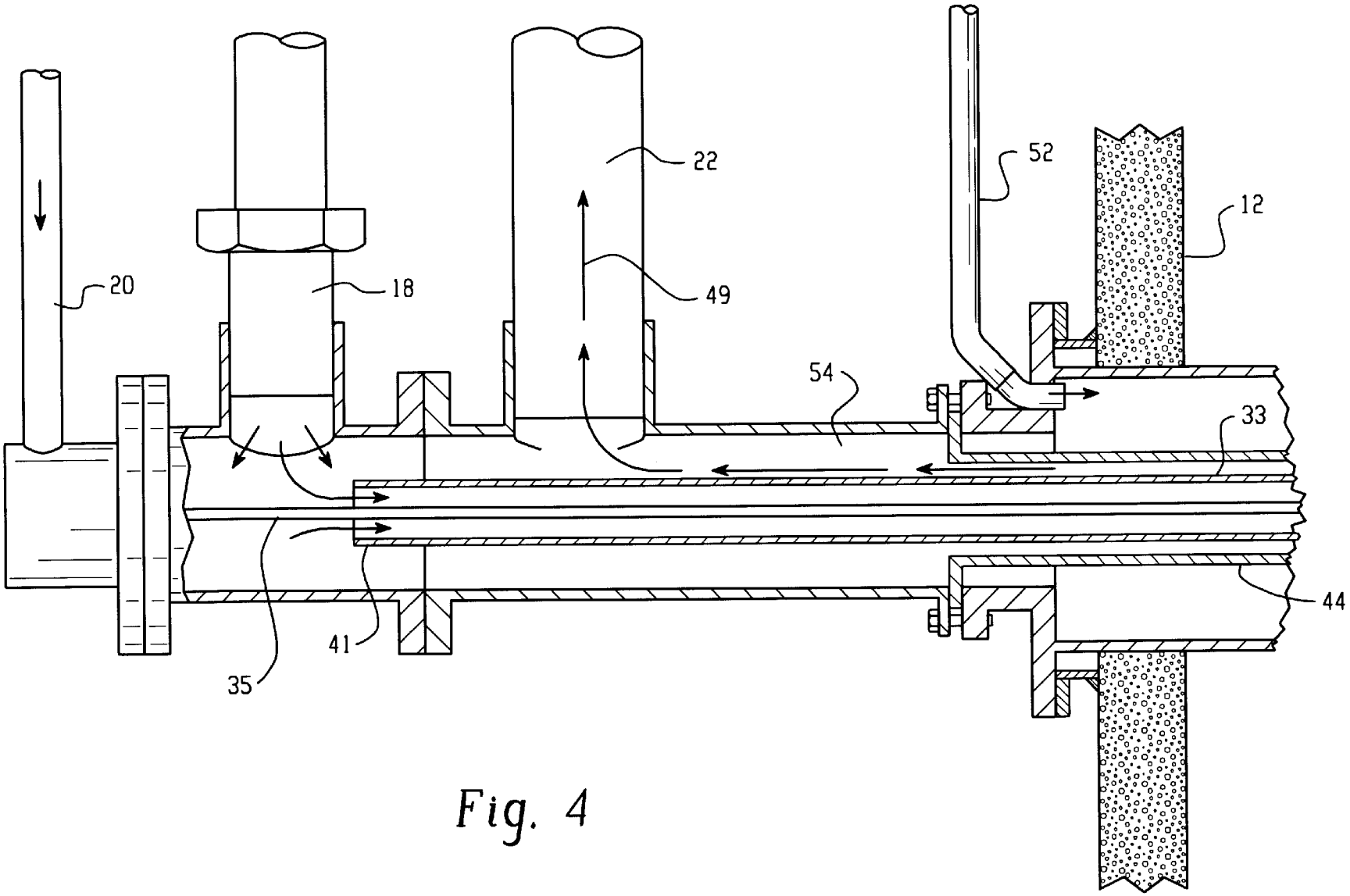
FIG. 4 is an enlarged view of a portion of FIG. 3.

Referring now to FIGS. 3 and 4 additional internal details of the device 10 are clearly illustrated. Specifically, device 10 includes a combustion tube 33 into which the fuel from inlet 18 is fed via tube 35. Provided at the end of tube 35 is a diffuser 37 having numerous openings that help to mix the air with the fuel within combustion tube 33. Air is fed into the combustion tube 33 via inlet 18. A conventional spark plug device (not shown) is included within the combustion tube 33 in order to ensure proper ignition and combustion of the enriching gas and air that is supplied. Combustion tube 33 which is open at its fore end 41 is also open at its distal end 42 and thus the products of combustion flow into outer radiant heater tube 44 and are exhausted via stack 22. Radiant heater tube 44 forms a cavity 43 around a portion of combustion tube 33. Cavity 43 facilitates the flow of gases formed in combustion tube 33 from tube 33 and into stack 22. Any one of a variety of hydrocarbon fuels may be used in the present invention. Examples of such fuels include, but are not limited to methane, propane, benzene vapors, ethane, petroleum distillates and mixtures thereof.

Surrounding a major portion of the radiant heater tube 44 is the generator tube 50. Generator tube 50 is located in the immediate proximity of the tube 44 and it forms a cavity 45. A mixture of air and enriching gas is fed into generator tube 50 by inlet tube 52. Preferably, the cavity 45 formed by generator tube 50 is filled at least half full with a catalyst 53 (partially shown) to promote the cracking or partial combustion of the air/enriching gas mix that is fed into tube 50. A suitable metal catalyst for use with the present invention is electrolytic nickel catalyst. It will be appreciated that any one of a variety of conventional metal catalysts may be employed. The partially combusted gas formed in generator tube 50 leaves the tube by openings 55 formed in outlet tube 25 and is fed into the process chamber of the furnace via diffuser tube 30. Heat formed by combustion in combustion tube 33 flows through radiant heater tube 44 and into the generator tube 50. This heat in combination with the catalyst serves to facilitate the cracking or partial combustion of the enriching gas that is fed into generator tube 50. In FIGS. 3 and 4 various arrows 49 are included to help illustrate the flow of the various gases in device 10.

Preferably, air and fuel are fed within combustion tube 33 at such a rate as to maintain the radiant heater tube 44 at a temperature of about 1500° F. to about 200° F. in order to ensure proper cracking of the enriching gas. Included in the process chamber 27 of furnace 15 are one or more conventional radiant heater tubes 51 for heating the furnace. Although combustion tube 33 generates some heat that ends up in the process chamber, the contribution by combustion tube 33 is minimal. The heat from combustion tube 33 being intended primarily for use in cracking the enriching gas in generator 50.

With the proper mixture of air and enriching gas flowing or being fed into the generator tube 50, and with the combustion tube being maintained at a temperature of from about 1500° F. to about 2000° F., a carburizing atmosphere is formed in the process chamber 27. The air is fed into the generator tube 50 at the rate of at least about 0.05 cubic feet of air for every 1 cubic foot of enriching gas that is fed into the generator tube. Preferably, from about 0.20 cubic feet to about 8 cubic feet of air is fed into the generator tube for about every 1 cubic foot of enriching gas that is fed into the generator tube. More preferably, from about 0.20 cubic feet to about 7 cubic feet of air is added for about every cubic foot of enriching gas added. It will be appreciated that the specific ratio of air to enriching gas may vary and may be dependent upon such factors as the specific enriching gas being utilized, the degree of carburization required, and the quality of the seal that the furnace is capable of maintaining (i.e., the ability of the furnace to prevent furnace atmosphere leakage or the ingress of gases into the furnace).

A preferred method of determining the carbon potential of the furnace atmosphere is by use of an oxygen probe or by the use of an infrared reader. Carbon potential may also be determined by monitoring the dew point. Generally, the lower the dew point, the higher the carbon potential of the furnace atmosphere. With the dew point in the process chamber of the furnace at zero, carbon will form quite rapidly and depending on the particular application the carbon may form excessively. Of course, excess carbon formation can be controlled by altering the mixture and providing a leaner mixture of enriching gas and air to the generator tube.

Prior to introducing the air and enriching gas mixture into the generator tube, there is no need to first provide or generate a furnace atmosphere using a carrier gas. The atmosphere may be generated and controlled solely by the use of applicant's carburizing device 10.

Upon introduction of the air and enriching gas into the carburizing device 10 the air and enriching gas raise the carbon potential of the furnace atmosphere by at least about 0.1%, preferably by at least about 0.2% and more preferably by at least about 0.3%. The air and the enriching gas are fed into the carburizing device for at least ten minutes, and preferably for at least one (1) hour.

Preferably, the air and the enriching gas are added simultaneously (as a mixture) to the generator tube. Preferably, two different mixtures of air and enriching gas are made available for use in the generator tube. One mixture is a lean mixture (about 1 part gas to 4 parts air) and the other mixture is richer (about 5 parts gas to 1 part air). The rich mixture produces a dew point of about −15° F. to about 10° F., and the lean mixture produces a dew point of about 25° F. to about 35° F. It will be appreciated that the degree of temperature control that is provided by having the generator tube in the immediate proximity of the combustion tube allows one to work with a minimal number of air/enriching gas mixtures.

The process is capable of being used to carburize any type of ferrous metal that is currently being carburized using conventional carburizing techniques. The process of the present invention is in no way limited to any particular class or grade of steel.

Various components of the carburizing device 10 may be constructed of any one of a number of materials that are conventionally employed within a carburizing furnace. For example, the combustion tube 33 may comprise a ceramic material such as silica carbide, and radiant heater tube 44 and outlet tube 25 may comprise an alloy such as a nickel alloy (nickel-iron-chromium 330, nickel-chromium-iron C600 or C601, or nickel-chromium-molybdenum CC625) or a stainless steel such as for example an austenitic chromium-nickel stainless steel such as 309S.

By way of illustration and not by any limitation, the following Example will describe a method of carburizing ferrous metal parts within the scope of the present invention.

ILLUSTRATIVE EXAMPLE 1

The furnace comprises a batch-type furnace. Such furnace includes a process chamber or main heating zone having a volume of about 150 cubic feet and a carburizing device as described above.

The process chamber was heated to a temperature of about 1700° F. and about 1000 pounds of high alloy steel parts and five 8620 alloy test pins located in the load at various locations were charged into the furnace. The furnace temperature dropped to about 1300° F. after loading. It took about 2 hours for the furnace to recover to 1700° F.

A mixture of air and methane (175 CFH of methane and 35 CFH of air) was then fed into the generator tube for about 5 hours while the combustion tube was held at a temperature of about 1850° F. At the 3 hour point the dew point reached −10° F. After 5 hours, the furnace temperature was lowered to 1550° F. It took 1.5 hours for the furnace to reach 1550° F., and during this period the generator tube was fed with a mixture of 166 CFH air and 59 CFH methane. The load was then quenched. The test pins displayed an effective case depth of 0.055 and the carbon content at the surface was over 1%. No unwanted carbides were found in the test pins.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

What is claimed is:

1. A carburizing device for use in carburizing metal parts comprising a combustion tube and a radiant heater tube for combusting air and a source of hydrocarbon fuel and generating a source of heat, a generator tube surrounding at least a portion of said radiant heater tube, said generator tube having an inlet for receiving a mixture of air and enriching gas, and an outlet tube for exhausting partially combusted enriching gas to the process chamber of a furnace.

2. The carburizing device of claim 1 including a diffuser tube attached to the outlet of said generator tube for distributing the partially combusted enriching gas to the process chamber of a furnace.

3. The carburizing device of claim 1 wherein said generator tube surrounds a major portion of the length of said radiant heater tube.

4. The carburizing device of claim 1 wherein a cavity is formed between said generator tube and said radiant heater tube, said cavity being at least partially filled with catalyst.

5. A carburizing device as set forth in claim 1 wherein a cavity is formed between said combustion tube and said radiant heater tube.

6. A method of carburizing ferrous metal parts in a furnace having a process chamber in which such parts are carburized and a carburizing device comprising a combustion tube and a radiant heater tube for combusting air and a source of hydrocarbon fuel and generating a source of heat, a generator tube surrounding at least a portion of said radiant heater tube, said generator tube having an inlet for receiving a mixture of air and enriching gas, and an outlet tube for exhausting partially combusted enriching gas to the process chamber of the furnace, said method comprising the steps of:

i) heating the process chamber to a temperature in excess of about 1100° F.;

ii) heating said radiant heater tube to a temperature of at least 1500° F. by combusting air and a source of hydrocarbon fuel within said radiant heater tube;

iii) charging such parts to be carburized into such process chamber;

iv) providing a source of air and enriching gas and feeding such air and enriching gas into such generator tube so as to partially decompose such enriching gas, and feeding such partially decomposed enriching gas from such generator tube and into such process chamber so as to raise the carbon potential of such furnace atmosphere in such process chamber by at least about 0.1%; and v) discharging such parts from such furnace.

7. A method as set forth in claim 6 wherein said enriching gas is selected from the group consisting of $CH_4$, CO, $C_2H_6$, $C_2H_4$, $C_6H_6$, $C_4H_1O$, $C_3H_8$ and mixtures of such gases.

8. A method as set forth in claim 6 wherein during said step iv at least about 0.05 cubic feet of such air is fed for about every 1 cubic foot of such enriching gas that is fed into such generator tube.

9. A method as set forth in claim 6 wherein during said step iv from about 0.20 cubic feet to about 8 cubic feet of such air is fed for about every cubic foot of such enriching gas that is fed into such generator tube.

10. A method as set forth in claim 6 wherein during said step iv from about 0.20 cubic feet to about 7 cubic feet of such air is fed for about every cubic foot of such enriching gas that is fed into such generator tube.

11. A method as set forth in claim 6 wherein such enriching gas and such air are fed simultaneously as a mixture into such generator tube.

12. A method as set forth in claim 6 wherein such air and enriching gas of said step iv is fed to such generator tube for a period of at least about ten minutes.

13. A method as set forth in claim 6 wherein such air and enriching gas of said step iv is fed to such generator tube for a period of at least about 1 hour.

14. A method as set forth in claim 6 wherein such furnace comprises a furnace selected from the group consisting of a rotary furnace, a rotary retort furnace, a continuous furnace and a batch furnace.

15. A method as set forth in claim 6 wherein during said step iv the dew point of such furnace atmosphere in such process chamber is lowered by at least about 1°.

* * * * *